US007411355B2

(12) United States Patent
Jang et al.

(10) Patent No.: US 7,411,355 B2
(45) Date of Patent: Aug. 12, 2008

(54) DISPLAY DEVICE AND DRIVING DEVICE OF LIGHT SOURCE FOR DISPLAY DEVICE

(75) Inventors: Hyeon-Yong Jang, Osan-si (KR); Sang-Gil Lee, Seoul (KR); Min-Gyu Kim, Seoul (KR); Nam-Ok Kwon, Seoul (KR)

(73) Assignee: Samsung Electronics Co., Ltd. (KR)

( * ) Notice: Subject to any disclaimer, the term of this patent is extended or adjusted under 35 U.S.C. 154(b) by 147 days.

(21) Appl. No.: 11/125,570

(22) Filed: May 10, 2005

(65) Prior Publication Data

US 2005/0269970 A1 Dec. 8, 2005

(30) Foreign Application Priority Data

Jun. 4, 2004 (KR) ..... 10-2004-0041002

(51) Int. Cl.
*H05B 37/00* (2006.01)

(52) U.S. Cl. ..... 315/209 R; 315/224; 315/307

(58) Field of Classification Search ..... 315/224, 315/209 R, 307, DIG. 5
See application file for complete search history.

(56) References Cited

U.S. PATENT DOCUMENTS 5,387,846 A * 2/1995 So ..... 315/209 R
6,252,355 B1 * 6/2001 Meldrum et al. ..... 315/150
6,326,740 B1 * 12/2001 Chang et al. ..... 315/291
2002/0047601 A1 4/2002 Shannon et al.
2004/0104691 A1 * 6/2004 Lott ..... 315/224

FOREIGN PATENT DOCUMENTS

| | | |
|---|---|---|
| JP | 06045080 | 2/1994 |
| JP | 09232094 | 9/1997 |
| JP | 11354286 | 12/1999 |
| JP | 2000243588 | 9/2000 |
| KR | 100165218 | 9/1998 |
| KR | 200193174 | 6/2000 |
| KR | 20010041876 | 5/2001 |
| KR | 100313768 | 10/2001 |
| KR | 1020040009103 | 1/2004 |

* cited by examiner

*Primary Examiner*—David H. Vu
(74) *Attorney, Agent, or Firm*—Cantor Colburn LLP

(57) ABSTRACT

A driving device of a light source includes an arc sensing unit and an inverter. The light source includes a lamp having a first terminal and a second terminal. The arc sensing unit extracts a high frequency component from a voltage applied to the light source and generates an arc sensing signal in response to the high frequency component. The inverter controls the light source in response to the sensing signal.

25 Claims, 8 Drawing Sheets

DISPLAY DEVICE AND DRIVING DEVICE OF LIGHT SOURCE FOR DISPLAY DEVICE

This application claims priority to Korean Patent Application Nos. 10-2004-0041002, filed on Jun. 4, 2004, the contents of which in its entirety are herein incorporated by reference.

BACKGROUND OF THE INVENTION (a) Field of the Invention

The present invention relates to a display device and a driving device of a light source for the display device.

(b) Description of Related Art

Display devices used for monitors of computers and television sets generally include self-emitting display devices such as organic light emitting displays (OLEDs), vacuum fluorescent displays (VFDs), field emission displays (FEDs), and plasma display panels (PDPs), and non-emitting display devices such as liquid crystal display devices (LCDs) requiring external light source.

An LCD device includes two panels provided with field-generating electrodes and a liquid crystal (LC) layer having dielectric anisotropy disposed between the two panels. The field-generating electrodes are supplied with voltages to generate an electric field across the LC layer, and a light transmittance of the LC layer varies in response to a strength of the electric field, which can be controlled by the voltages supplied. Accordingly, images are displayed by adjusting the voltages supplied.

Light for an LCD device is provided, for example, by an artificial light source provided with the LCD device or by a natural light source. Lamps disposed at the LCD device are an example of the artificial light source. When employing the lamps, a brightness on a screen of the LCD device is usually changed by adjusting a ratio of on and off durations of the lamps or by adjusting a current flowing through the lamps.

The artificial light source, which may be part of a backlight assembly, is often implemented as a plurality of fluorescent lamps such as CCFL (cold cathode fluorescent lamp) and EEFL (external electrode fluorescent lamp) driven by an inverter. The inverter converts a DC voltage into an AC voltage and applies the AC voltage to the lamps to turn the lamps on. The inverter adjusts luminance of the lamps based on a luminance control signal, which is provided to control a luminance of the LCD device. In addition, the inverter controls voltages applied to the lamps based on currents of the lamps.

When the fluorescent lamps are employed as the lamps for the LCD device, the inverter applies a high voltage to the lamps for initial lighting. Thus, if a terminal of the lamp supplied with the high voltage has poor insulation or contact resistance between the terminal of the lamp and a terminal of the inverter, an arc may be generated, which exerts a bad influence on operation of the backlight assembly and may cause a fire in the inverter.

To prevent arc generation, a human inspector inspects a connection state between the lamp and the inverter after manufacturing the inverter. In addition, a separate arc sensing unit may be used, which stops operation of the inverter if an arc is generated.

However, though a manufactured inverter passes a visual inspection by the inspector, the connection state may become poor during subsequent carrying or using of the inverter, thereby creating conditions that allow arc generation. Thus, the arc sensing unit is used to provide continuing protection against arc generation.

Unfortunately, in a conventional arc sensing unit, it is difficult to distinguish between noise components included among normal control signals and arcs. Thus, the conventional arc sensing unit may turn off the lamps in response to the noise components, thereby decreasing a reliability of the inverter.

Therefore, a need exists for a display device that can includes an arc sensing unit able to distinguish between noise and arcs.

SUMMARY OF THE INVENTION

A driving device of a light source for a display device is provided, the light source including lamps electrically connected in parallel with each other and each lamp having a first terminal and a second terminal. The driving device includes an arc sensing unit and an inverter. The light source includes a lamp having a first terminal and a second terminal. The arc sensing unit extracts a high frequency component from a voltage applied to the light source and generates an arc sensing signal in response to the high frequency component. The inverter controls the light source in response to the sensing signal.

A driving device of a light source for a display device is provided, the light source including a lamp. The driving device includes an inverter, a voltage divider, a high pass filter and an AC-DC converter. The inverter applies an AC voltage to the lamp and turns on and off the lamp. The voltage divider is electrically connected to the lamp. The high pass filter is electrically connected to the voltage divider. The AC-DC converter is electrically connected to the high pass filter and the inverter.

A driving device of a light source for a display device is provided, the light source including at least one lamp having a first terminal and a second terminal. the driving device includes an inverter, a first voltage divider, a second voltage divider, a first high pass filter, a second high pass filter and an AC-DC converter. The inverter applies an AC voltage to the lamp and turns on and off the lamp. The first voltage divider is electrically connected to the first terminal of lamp. The second voltage divider is electrically connected to the first voltage divider and the second terminal of lamp. The first high pass filter is electrically connected to the first voltage divider. The second high pass filter is electrically connected to the second voltage divider. The AC-DC converter is electrically connected to the first and second high pass filters and the inverter.

A display device is provided. The display device includes pixels arranged in a matrix, a light source supplying light to the pixels, a high frequency sensing unit extracting a high frequency component from a voltage applied to the light source and generating a high frequency sensing signal in response to the high frequency component, and an inverter controlling the light source in response to the high frequency sensing signal.

BRIEF DESCRIPTION OF THE DRAWINGS

The present invention will become more apparent by describing exemplary embodiments thereof in detail with reference to the accompanying drawings in which.

DETAILED DESCRIPTION OF THE INVENTION

Figure 1:
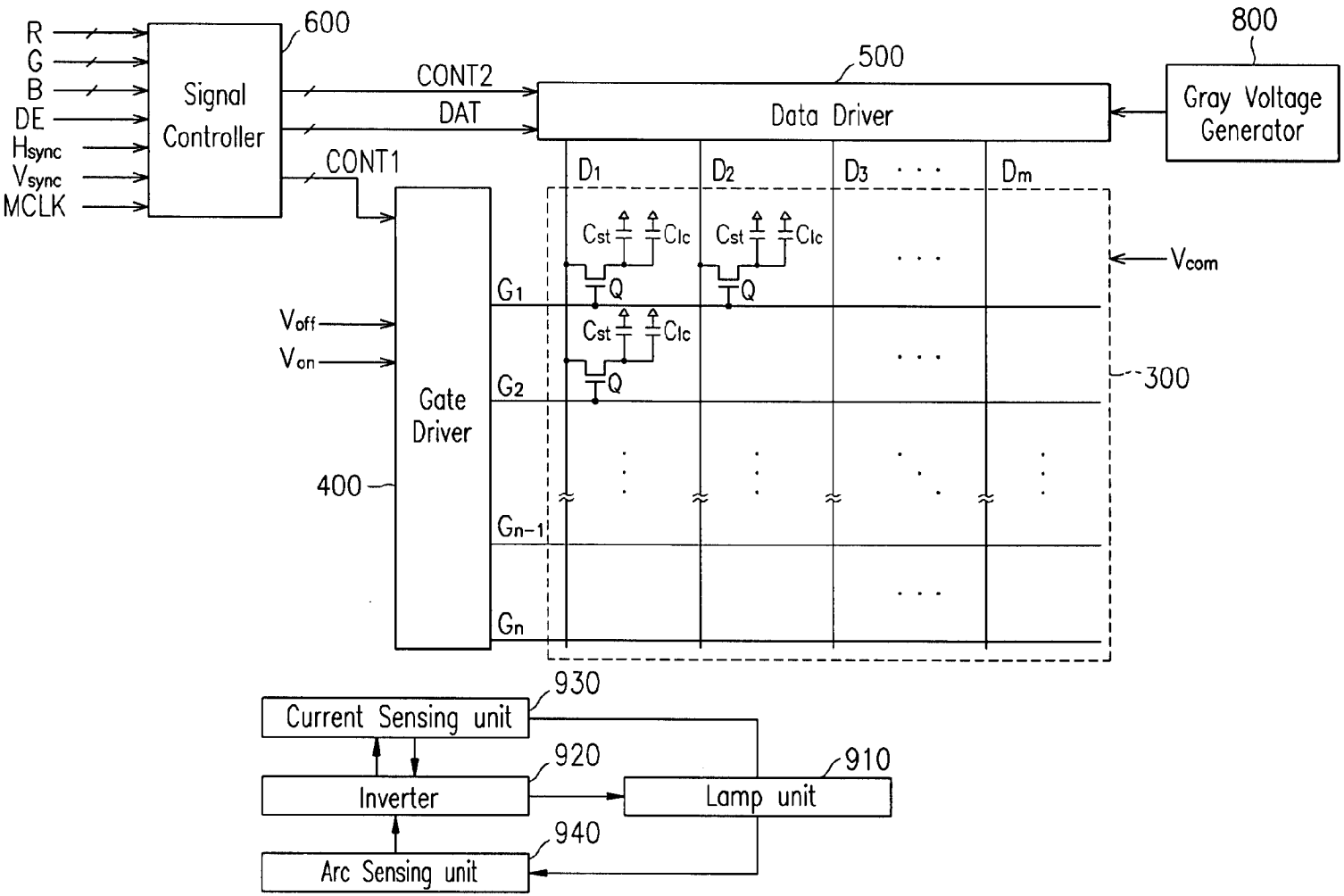
FIG. 1 is a block diagram of an LCD device according to an exemplary embodiment of the present invention.

The present invention now will be described more fully hereinafter with reference to the accompanying drawings, in which exemplary embodiments of the invention are shown.

In the drawings, thickness of layers and regions are exaggerated for clarity. Like numerals refer to like elements throughout. It will be understood that when an element such as a layer, film, region, substrate or panel is referred to as being "on" another element, it can be directly on the other element or intervening elements may also be present. In contrast, when an element is referred to as being "directly on" another element, there are no intervening elements present.

A liquid crystal display (LCD) device according to an exemplary embodiment of the present invention will now be described in detail with reference to FIGS. 1-3.

Figure 2:
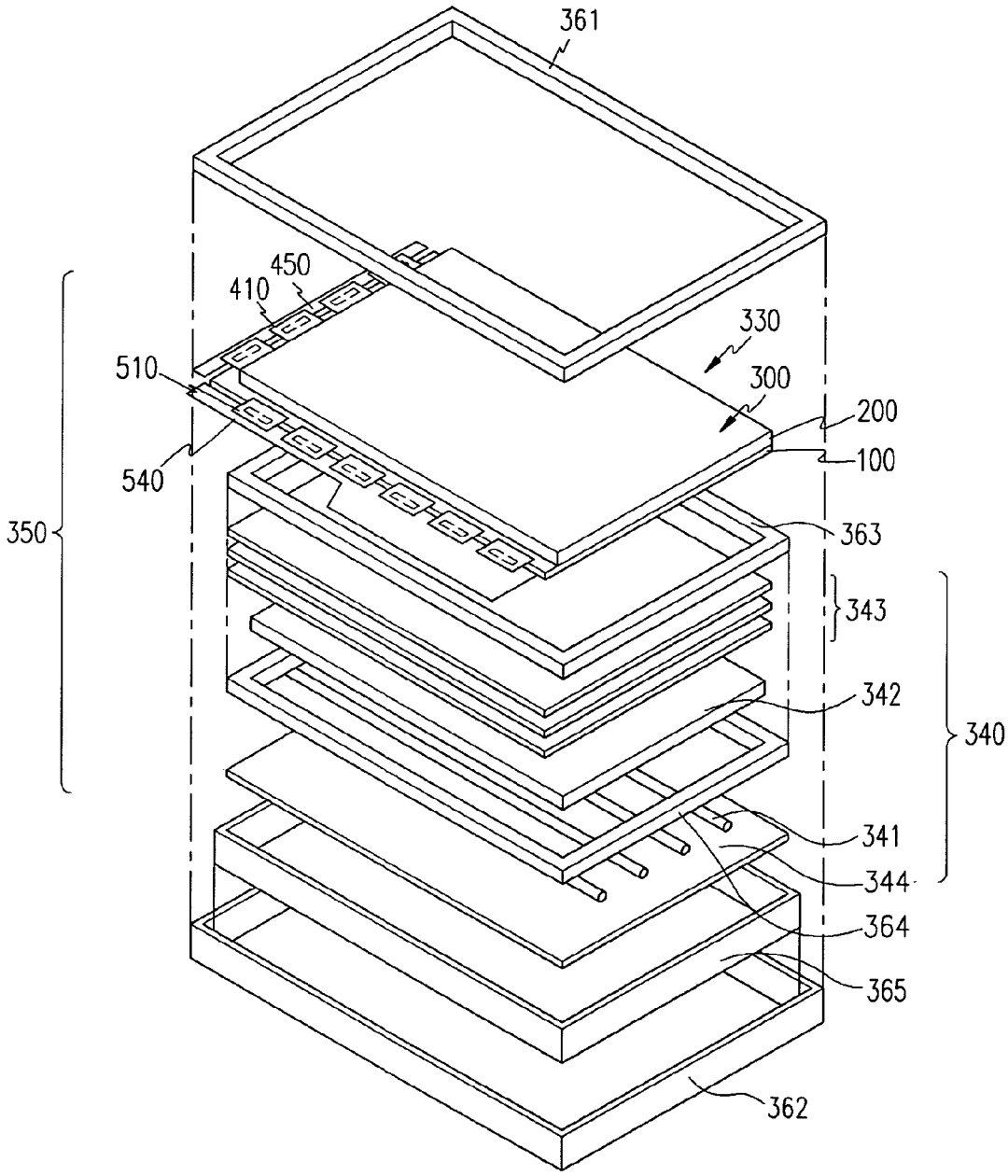
FIG. 2 is an exploded perspective view of the LCD device shown in FIG. 1.
Figure 3:
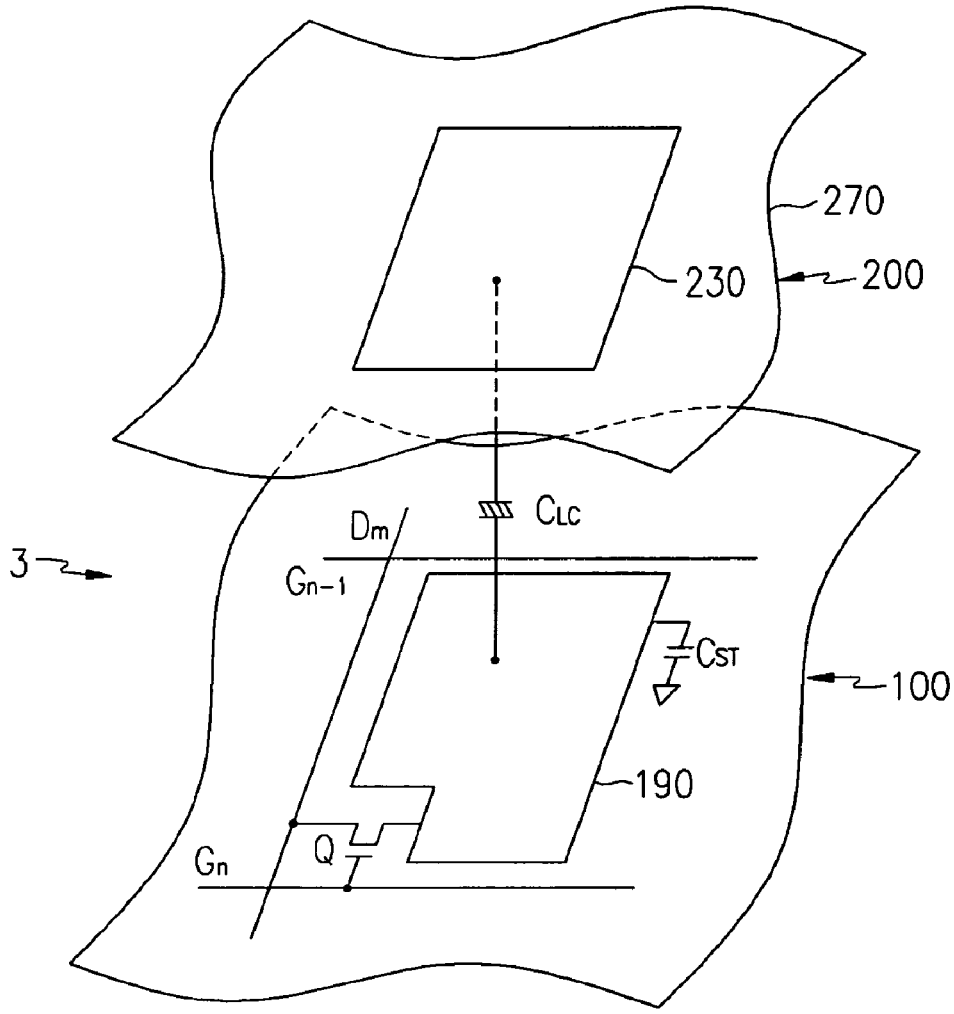
FIG. 3 is an equivalent circuit diagram of a pixel of the LCD device shown in FIG. 1.

FIG. 1 is a block diagram of an LCD device according to an embodiment of the present invention, FIG. 2 is an exploded perspective view of the LCD device shown in FIG. 1, and FIG. 3 is an equivalent circuit diagram of a pixel of the LCD device shown in FIG. 1.

Referring to FIG. 1, an LCD device according to an embodiment of the present invention includes a liquid crystal (LC) panel assembly 300, a gate driver 400 and a data driver 500 connected to the LC panel assembly 300, a gray voltage generator 800 connected to the data driver 500, a lamp unit 910 emitting light toward the LC panel assembly 300 and an inverter 920 electrically connected to the lamp unit 910, an arc sensing unit 940 electrically connected between the lamp unit 910 and the inverter 920, a current sensing unit 930 electrically connected between the lamp unit 910 and the inverter 920, and a signal controller 600 controlling the above-described elements.

As shown in FIG. 2, the LCD device according to an embodiment of the present invention includes an LC module 350 including a display unit 330 and the backlight assembly 340, a front chassis 361 and a rear chassis 362 containing and fixing the LC module 350, a mold frame 364, a first middle chassis 363 and a second middle chassis 365.

The display unit 330 includes the LC panel assembly 300, a plurality of gate tape carrier packages (TCPs) 410 and a plurality of data TCPs 510 attached to the LC panel assembly 300, and a gate printed circuit board (PCB) 450 and a data PCB 540 attached to the gate and data TCPs 410 and 510, respectively.

The display panel assembly 300 includes a lower panel 100, an upper panel 200, and a liquid crystal layer 3 disposed between the lower and upper panels 100 and 200, as shown in FIGS. 2 and 3. The display panel assembly 300 includes a plurality of display signal lines $G_1$-$G_n$ and $D_1$-$D_m$ and a pixels electrically connected to selected ones of the display signal lines $G_1$-$G_n$ and $D_1$-$D_m$ and arranged substantially in a matrix as shown in FIGS. 1 and 3.

The display signal lines $G_1$-$G_n$ and $D_1$-$D_m$ are disposed on the lower panel 100 and include gate lines $G_1$-$G_n$ transmitting gate signals (also referred to as "scanning signals") and data lines $D_1$-$D_m$ transmitting data signals. The gate lines $G_1$-$G_n$ extend substantially in a row direction and are substantially parallel to each other, while the data lines $D_1$-$D_m$ extend substantially in a column direction and are substantially parallel to each other.

Each pixel includes a switching element Q connected to selected ones of the display signal lines $G_1$-$G_n$ and $D_1$-$D_m$, and an LC capacitor $C_{LC}$ and a storage capacitor $C_{ST}$ that are electrically connected to the switching element Q. The storage capacitor $C_{ST}$ may be omitted if unnecessary.

The switching element Q may be implemented as a thin film transistor (TFT) disposed on the lower panel 100. The switching element Q has three terminals: a control terminal electrically connected to one of the gate lines $G_1$-$G_n$; an input terminal electrically connected to one of the data lines $D_1$-$D_m$; and an output terminal electrically connected to the LC capacitor $C_{LC}$ and the storage capacitor $C_{ST}$.

The LC capacitor $C_{LC}$ includes a pixel electrode 190 provided on the lower panel 100 as a first terminal and a common electrode 270 provided on the upper panel 200 as a second terminal. The LC layer 3 disposed between the pixel and common electrodes 190 and 270 functions as a dielectric of the LC capacitor $C_{LC}$. The pixel electrode 190 is electrically connected to the switching element Q, and the common electrode 270 is supplied with a common voltage Vcom and covers an entire surface of the upper panel 200. As an alternative to the embodiment shown in FIG. 3, the common electrode 270 may be provided on the lower panel 100, and both the pixel and common electrodes 190 and 270 may have shapes of bars or stripes.

The storage capacitor $C_{ST}$ is an auxiliary capacitor for the LC capacitor $C_{LC}$. The storage capacitor $C_{ST}$ includes the pixel electrode 190 and a separate signal line, which is provided on the lower panel 100, overlaps the pixel electrode 190 via an insulator, and is supplied with a predetermined voltage such as the common voltage Vcom. Alternatively, the storage capacitor $C_{ST}$ may include the pixel electrode 190 and an adjacent gate line called a previous gate line, which overlaps the pixel electrode 190 via an insulator.

For a color display, each pixel uniquely represents one of primary colors (i.e., spatial division) or each pixel sequentially represents the primary colors in turn (i.e., temporal division) such that a spatial or temporal sum of the primary colors is recognized as a desired color. An example of a set of the primary colors includes red, green, and blue colors. FIG. 3 shows an example of the spatial division in which each pixel includes a color filter 230 representing one of the primary colors disposed at an area of the upper panel 200 facing the pixel electrode 190. Alternatively, the color filter 230 is provided on or under the pixel electrode 190 on the lower panel 100.

The backlight assembly 340 includes lamps 341 disposed behind the LC panel assembly 300 and forming a portion of the lamp unit 910 shown in FIG. 1, a spread plate 342 and optical sheets 343 disposed between the panel assembly 300 and the lamps 341. The spread plate 342 guides and diffuses light from the lamps 341 to the panel assembly 300. The backlight unit also includes a reflector 344 disposed under the lamps 341 to reflect light from the lamps 341 toward the panel assembly 300.

The first middle chassis 363 is disposed between the LC panel assembly 300 and the optical sheets 343 and uniformly maintains a distance between the LC panel assembly 300 and the optical sheets 343. The mold frame 364 is disposed between the lamps 341 and the spread plate 342, uniformly maintains a distance between the lamps 341 and the spread plate 342, and supports the spread plate 342 and the optical sheets 343.

The lamps 341 include EEFLs (external electrode fluorescent lamps) or CCFLs (cold cathode fluorescent lamps), but may be LEDs (light emitting diodes). As shown in FIG. 2, a number of the lamps 341 in an exemplary embodiment is four, but the number of the lamps 341 may be determined in consideration of operational requirements of the LCD device.

Although, as shown in FIG. 2, the lamps may be disposed under an LC panel assembly 300, such as in a direct-type backlight assembly, the lamps may alternatively be disposed along one or more edges of the LC panel assembly 300, such as in an edge-type backlight assembly. The edge-type backlight assembly includes a light guide plate instead of the spread plate 342.

The inverter 920 may be mounted on a stand-alone inverter PCB (not shown), on the gate PCB 450 or the data PCB 540. The current sensing unit 930 and the arc sensing unit 940 may be mounted on the inverter PCB, on the gate PCB 450 or on the data PCB 540.

One or more polarizers (not shown) for polarizing the light from the lamps 341 are attached to outer surfaces of the lower and upper panels 100 and 200.

Referring to FIGS. 1 and 2, the gray voltage generator 800 on the data PCB 550 generates two sets of gray voltages related to a transmittance of the pixels. The gray voltages in a first set have a positive polarity with respect to the common voltage Vcom, while the gray voltages in a second set have a negative polarity with respect to the common voltage Vcom.

The gate driver 400 includes a plurality of integrated circuit (IC) chips mounted on respective gate TCPs 410. The gate driver 400 is electrically connected to the gate lines $G_1$-$G_n$ of the panel assembly 300 and synthesizes a gate-on voltage Von and a gate off voltage Voff from an external device to generate gate signals for application to the gate lines $G_1$-$G_n$.

The data driver 500 includes a plurality of IC chips mounted on respective data TCPs 510. The data driver 500 is electrically connected to the data lines $D_1$-$D_m$ of the panel assembly 300 and applies data voltages selected from the gray voltages supplied from the gray voltage generator 800 to the data lines $D_1$-$D_m$.

According to another exemplary embodiment of the present invention, the IC chips of the gate driver 400 or the data driver 500 are mounted on the lower panel 100. According to yet another exemplary embodiment, one or both of the gate and data drivers 400 and 500 are incorporated along with other elements into the lower panel 100. The gate PCB 450 and/or the gate TCPs 410 may be omitted in such embodiments.

The signal controller 600 controlling the gate and data drivers 400 and 500, etc. is disposed on the data PCB 540 or the gate PCB 450.

Operation of the LCD device will now be described in detail with reference to FIGS. 1 to 3.

Referring to FIG. 1, the signal controller 600 is supplied with input image signals R, G and B and input control signals for controlling a display of the LCD device. The input control signals include a vertical synchronization signal Vsync, a horizontal synchronization signal Hsync, a main clock MCLK, and a data enable signal DE, all of which are provided from an external graphics controller (not shown). After generating gate control signals CONT1 and data control signals CONT2 and processing the input image signals R, G and B suitable for operation of the panel assembly 300 in response to the input control signals and the input image signals R, G and B, the signal controller 600 provides the gate control signals CONT1 to the gate driver 400, and processed image signals DAT and the data control signals CONT2 to the data driver 500.

The gate control signals CONT1 include a scanning start signal STV for instructing the gate driver 400 to start scanning and at least a clock signal for controlling an output time of the gate-on voltage Von. The gate control signals CONT1 may further include an output enable signal OE for defining a duration of the gate-on voltage Von.

The data control signals CONT2 include a horizontal synchronization start signal STH for informing the data driver 500 of a start of data transmission for a group of pixels, a load signal LOAD for instructing the data driver 500 to apply data voltages to the data lines $D_1$-$D_m$, and a data clock signal HCLK. The data control signals CONT2 may further include an inversion signal RVS for reversing a polarity of the data voltages (with respect to the common voltage Vcom).

Responsive to the data control signals CONT2 from the signal controller 600, the data driver 500 receives a packet of the processed image signals DAT for the group of pixels from the signal controller 600, converts the processed image signals DAT into analog data voltages selected from the gray voltages supplied from the gray voltage generator 800, and applies the data voltages to the data lines $D_1$-$D_m$.

The gate driver 400 applies the gate-on voltage Von to the gate line $G_1$-$G_n$ in response to the gate control signals CONT1 from the signal controller 600, thereby turning on selected switching elements Q. The data voltages applied to the data lines $D_1$-$D_m$ are supplied to the pixels through turned-on switching elements Q.

A difference between the data voltage and the common voltage Vcom applied to a pixel is expressed as a charged voltage of the LC capacitor $C_{LC}$, i.e., a pixel voltage. LC molecules of the LC layer 3 have orientations that vary in response to a magnitude of the pixel voltage.

The inverter 920 converts a DC voltage from an external source into an AC voltage and applies the AC voltage to the lamp unit 910, to light the lamp unit 910. A brightness of the lamp unit 910 is controlled responsive to the AC voltage. The inverter 920 receives information about an amount of current flowing through the lamp unit 910 via the current sensing unit 930, and information about arc generation via the arc sensing unit 940, and controls operation of the lamp unit 910 responsive to the information.

Light from the lamp unit 910 passes through the LC layer 3 and experiences a change of polarization. The change of polarization is converted into a change of light transmittance by the polarizers.

By repeating the above-mentioned procedure each horizontal period (which is denoted by "1H" and equal to one period of the horizontal synchronization signal Hsync and the data enable signal DE), all gate lines $G_1$-$G_n$ are sequentially supplied with the gate-on voltage Von during a frame, thereby applying the data voltages to all pixels. When a next frame starts after finishing one frame, the inversion control signal RVS applied to the data driver 500 is controlled such that the polarity of the data voltages is reversed (which is referred to as "frame inversion"). The inversion control signal RVS may be also controlled such that the polarity of the data voltages flowing in a data line in one frame are reversed (for example, line inversion and dot inversion), or such that the polarity of the data voltages in one packet are reversed (for example, column inversion and dot inversion).

The lamp unit 910, the inverter 920, the current sensing unit 930 and the arc sensing unit 940 according to an exemplary embodiment of the present invention will now be described in detail with reference to FIG. 4.

The lamp unit 910 includes a lamp LP having a high voltage terminal H and a low voltage terminal L and a capacitor C1 connected between the high voltage terminal H and ground. In an exemplary embodiment, the capacitor C1 is a ballast capacitor and the lamp LP is a CCFL. For convenience of explanation, only one lamp LP is illustrated in FIG. 4, although it is understood that any number of lamps may be employed in the lamp unit 910.

The inverter 920 includes a transforming unit 921, a switching unit 922 electrically connected to the transforming unit 921, and an inverter controller 923 electrically connected to the switching unit 922.

The transforming unit 921 is a transformer T having a primary coil L1 and a secondary coil L2. Both ends of the primary coil L1 are electrically connected to the switching unit 922. A first terminal of the secondary coil L2 is electrically connected to the high voltage terminal H of the lamp LP and a second terminal of the secondary coil L2 is electrically connected to ground.

The arc sensing unit 940 includes a filtering unit 941 and an AC-DC converter 942 electrically connected to the filtering unit 941.

The filtering unit 941 includes a voltage divider DV having, for example, resistor R2, resistor R3 and resistor R4 electrically connected to divide a voltage provided at the high voltage terminal H of the lamp LP, and a high pass filter HPF having a capacitor C2 electrically connected between a terminal A at which the resistors R3 and R4 are electrically connected, and a terminal B at which resistor R5 is electrically connected between the capacitor C2 and ground.

The AC-DC converter 942 includes a rectifying diode D3 electrically connected between the terminal B and a terminal C at which inverter controller 923 is electrically connected to a smoothing capacitor C3 that is electrically connected between the terminal C and ground. The inverter controller 923 is receptive of an arc sensing signal Sa from the AC-DC converter 942 via the terminal C.

The current sensing unit 930 includes a pair of diodes D1 and D2 electrically connected between the low voltage terminal L of the lamp LP and ground. The diodes D1 and D2 are arranged opposite each other with respect to the low voltage terminal L of the lamp LP and a resistor R1 is electrically connected between the diode D1 and ground. In other words, a cathode of the diode D1 is electrically connected to the resistor R1 and an anode of the diode D1 is electrically connected to the low voltage terminal L of the lamp LP, and an anode of the diode D2 is electrically connected to ground and the cathode of the diode D2 is electrically connected to the low voltage terminal L of the lamp LP.

The inverter controller 923 is supplied with a signal outputted from a terminal located between the diode D1 and the resistor R1 as a current sensing signal Sc.

Operation of the lamp unit 910, the inverter 920, the current sensing unit 930, and the arc sensing unit 940 will now be described in detail with reference to FIGS. 4 and 5.

Figure 4:
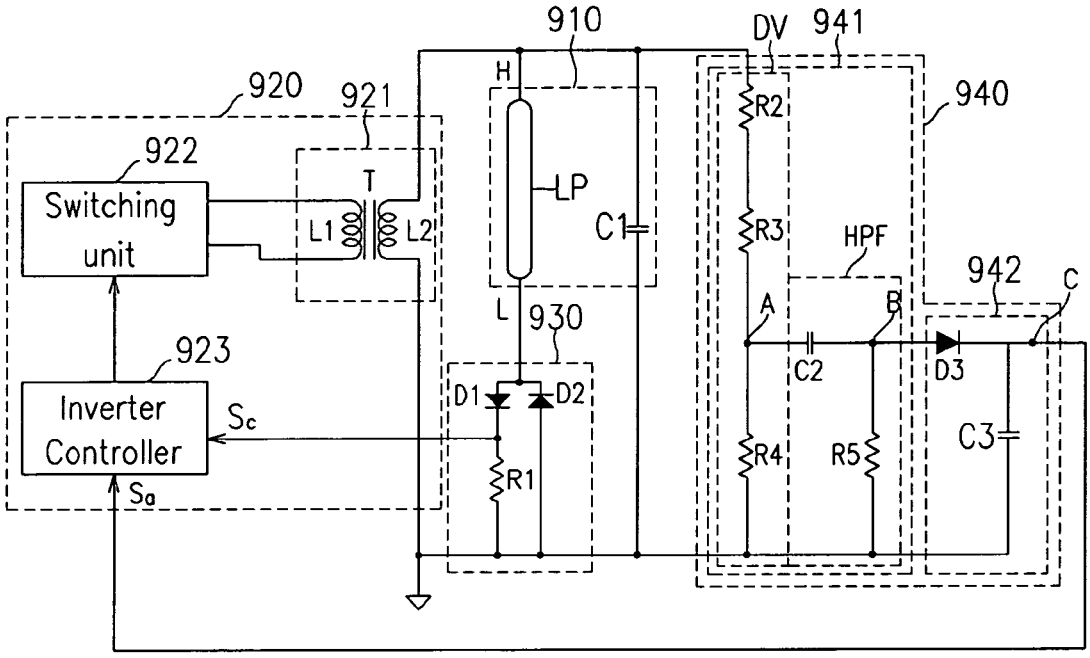
FIG. 4 is a circuit diagram of a light emitting unit according to an exemplary embodiment of the present invention.
Figure 5:
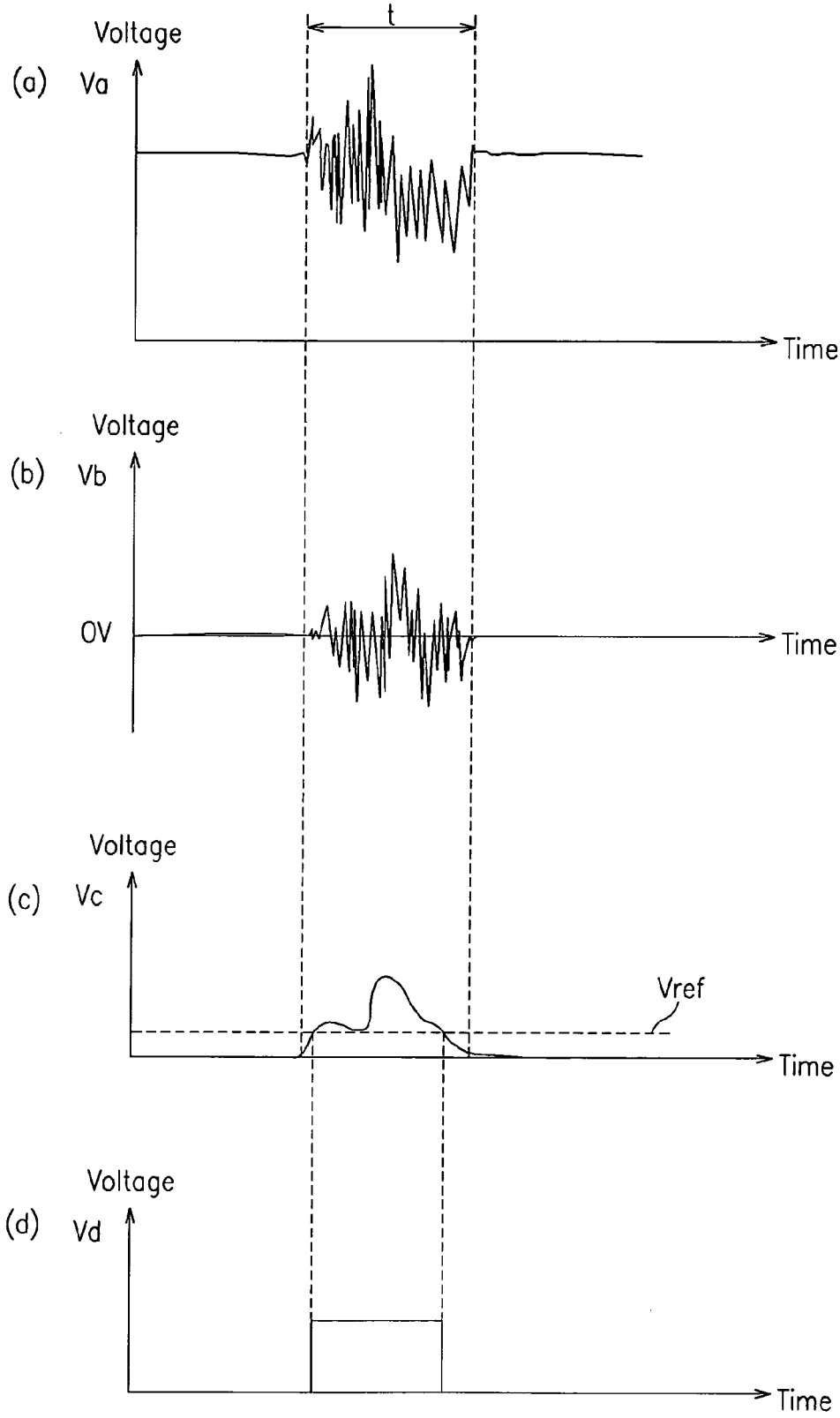
FIG. 5 illustrates signal waveforms measured at a plurality of points of an arc sensing unit shown in FIG. 4.

FIG. 5 illustrates signal waveforms measured in a plurality of points of the arc sensing unit shown in FIG. 4. Plots (a) to (c) of FIG. 5 illustrate signal waveforms detected at the terminals A, B and C of FIG. 4, respectively, and (d) of FIG. 5 illustrates a waveform of a result signal obtained by comparing the signal waveform illustrated in (c) to a reference voltage Vref.

The inverter controller 923 of the inverter 920 pulse width modulates a DC control signal (not shown) applied from an external source to produce a modulated signal in response to a saw tooth wave having a predetermined frequency applied from an oscillator (not shown), and applies the modulated signal as a dimming control signal to the switching unit 922.

The switching unit 922 converts a DC voltage (not shown) into an AC voltage in response to the dimming control signal and applies the AC voltage to the primary coil L1 of the transforming unit 921.

The transforming unit 921 boosts up the AC voltage from the switching unit 922 responsive to a turns ratio of the primary coil L1 and the secondary coil L2, to output a high voltage to be applied to the lamp LP of the lamp unit 910 for turning on the lamp. The capacitor C1 functions as the ballast capacitor in order to provide the high voltage required for initial lighting of the lamp LP.

A lamp voltage applied to the lamp LP is also applied to the filtering unit 941 of the arc sensing unit 940. Thus, the lamp voltage is divided and filtered by the voltage divider DV and the high pass filter HPF of the filtering unit 941, respectively.

An arc discharge may be generated from, for example, a terminal of the transforming unit 921 to the high voltage terminal H of the lamp unit 910 due to poor connection between a terminal of the secondary coil L2 of the transforming unit 921 and the high voltage terminal H of the lamp unit 910, or from the high voltage terminal H, due to bad insulation of the high voltage terminal H. The arc discharge includes a large high frequency component. The lamp voltage applied to the high voltage terminal H includes a noise component due to peripheral circuits or devices, which has a frequency lower than that of the high frequency component of the arc discharge. For example, a frequency of the high frequency component of the arc discharge is about 3 MHz or more, but a frequency of the noise component is about 1 MHz or less. Hereinafter, a component having a frequency less than the high frequency component of the arc discharge is referred to as a low frequency component. In an exemplary embodiment of the present invention, the low frequency component includes the noise component.

The resistors R2-R4 divide voltage levels regardless of frequency and thus pass all of the low frequency component, the noise component, and the high frequency component.

In response to the arc discharge being generated in a period "t" of FIG. 5, a waveform of a voltage Va is detected at terminal A of the voltage divider DV which includes the high frequency component as shown in (a) of FIG. 5. The high pass filter HPS, which has a bandwidth defined by a capacitance value of the capacitor C2 and a resistance value of the resistor R5 passes signals having a frequency greater than a selected threshold that ensures the high frequency component including the arc discharge is passed. The signal outputted at terminal B is a signal Vb including the high frequency component, i.e., corresponding to the arc discharge, shown in (b) of FIG. 5.

The AC-DC converter 942 half-wave rectifies the signal Vb to produce a half-wave rectified signal using the rectifying diode D3. The AC-DC converter 942 then smoothes the half-wave rectified signal using the smoothing capacitor C3 to output a voltage Vc with a waveform as shown in (c) of FIG. 5 as the arc sensing signal Sa at terminal C point and to apply the arc sensing signal Sa to the inverter controller 923.

The inverter controller 923 compares the arc sensing signal Sa from the arc sensing unit 940 to the reference voltage Vref. The reference voltage Vref may be applied from an external source or defined in the inverter controller 923.

In response to the arc sensing signal Sa being larger than the reference voltage Vref, the inverter controller 923 turns off the lamp unit 910. On the contrary, in response to the arc sensing signal Sa being smaller than the reference voltage Vref, the inverter controller 923 maintains a lighting state of the lamp unit 910.

For example, by using a circuit such as a comparator, the inverter controller 923 may generate a comparison signal Vd having a pulse width corresponding to a period during which the arc sensing signal Sa is greater than the reference voltage Vref. The inverter controller 923 turns off the lamp unit 910 responsive to the comparison signal Vd, either directly or indirectly, for example, by controlling the switching unit 922.

An AC current flowing through the lamp LP is applied to the current sensing unit 930. The diode D1 of the current sensing unit 930 half-wave rectifies the AC current flowing through the lamp LP to produce a half-wave rectified AC current. The half-wave rectified AC current flows to ground through the resistor R1. The diode D2 functions to pass a current flowing in the reverse direction.

Since a voltage applied to the resistor R1 is proportional to the current flowing through the lamp LP, a voltage outputted from between the diode D1 and the resistor R1 as the current sensing signal Sc is applied to the inverter controller 923. The inverter controller 923 varies a level of the DC control signal which changes frequency and period etc. of the AC voltage applied to the transforming unit 921 from the switching unit 922, in response to the current sensing signal Sc. Thus, a total current flowing via each lamp LP is constant.

Operation of the lamp unit 910, an inverter 920*a*, the current sensing unit 930, and an arc sensing unit 940*a* according to another exemplary embodiment of the present invention will be now described in detail with reference to FIG. 6.

Figure 6:
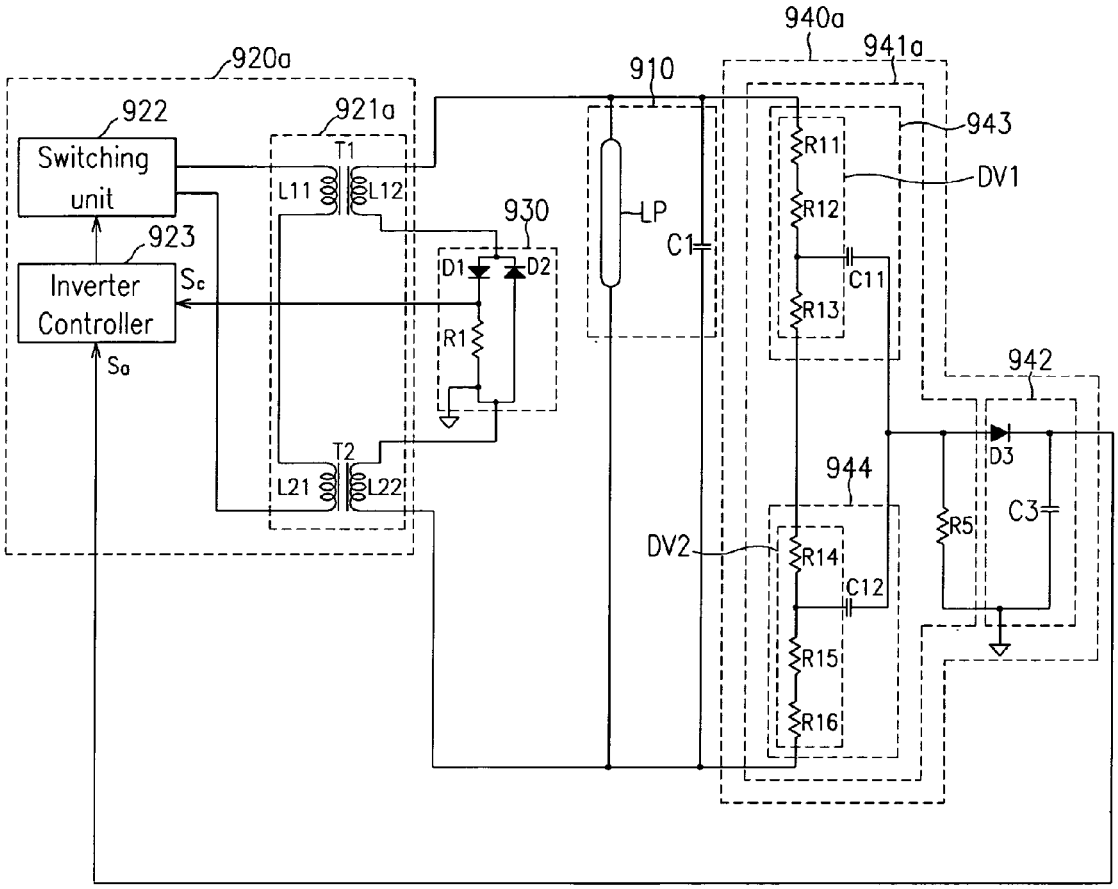
FIG. 6 is a circuit diagram of a light emitting unit according to another exemplary embodiment of the present invention.

FIG. 6 is a circuit diagram of a light emitting unit according to another exemplary embodiment of the present invention.

Referring to FIG. 6, the light emitting unit according to this exemplary embodiment of the present invention includes the lamp unit 910, the inverter 920*a* electrically connected to the lamp unit 910, the arc sensing unit 940*a* electrically connected between the lamp unit 910 and the inverter 920*a*, and the current sensing unit 930 electrically connected to the inverter 920*a*.

The lamp unit 910 includes the lamp LP, and the capacitor C1 electrically connected in parallel with the lamp LP. The capacitor C1 acts as the ballast capacitor and the lamp LP is, for example, a CCFL. For convenience, as shown in FIG. 4, only one lamp LP is illustrated, although it is understood that any number of lamps may be employed in the lamp unit 910.

The inverter 920*a* includes a transforming unit 921*a*, the switching unit 922 electrically connected to the transforming unit 921*a*, and the inverter controller 923 electrically connected to the switching unit 922, the current sensing unit 930 and the arc sensing unit 940*a*.

The transforming unit 921*a* includes two transformers T1 and T2 having primary coils L11 and L21, and secondary coils L12 and L22, respectively.

A first terminal of each of the primary coils L11 and L21 of the transformers T1 and T2 is connected to the switching unit 922, and a second terminal of each of the primary coils L11 and L21 is electrically connected to each other. In addition, a first terminal of each of the secondary coils L12 and L22 of the transformers T1 and L2 is electrically connected to opposite ends of the lamp LP, respectively, and a second terminal of each of the secondary coils L12 and L22 is electrically connected to opposite ends of the current sensing unit 930, respectively.

The arc sensing unit 940*a* includes a filtering unit 941*a* connected to the opposite ends of the lamp LP and the AC-DC converter 942 electrically connected to the filtering unit 941*a*.

The filtering unit 941*a* includes a first filtering subunit 943 and a second filtering subunit 944, and the resistor R5 electrically connected to a common terminal between the first and second filtering subunits 943 and 944 and ground. The AC-DC converter 942 is electrically connected to an input terminal of the inverter controller 923.

Construction of the first filtering subunit 943 is substantially similar to that of the second filtering subunit 944. For example; each filtering subunit 943 and 944 includes a voltage divider DV1 and DV2, respectively. The voltage divider DV1 includes series connected resistors R11-R13 and the voltage divider DV2 includes series connected resistors R14-R16. All of the resistors R11-R16 are electrically connected in series with each other to form a resistor bank. The resistor bank is electrically connected in parallel with the lamp LP. A first terminal of capacitor C11 is electrically connected to a node between resistors R12 and R13 and a second terminal of the first capacitor C11 is electrically connected to a first terminal of capacitor C12. The first terminal of capacitor C12 is electrically connected to the second terminal of capacitor C11 and a second terminal of capacitor C12 is electrically connected to a node between the resistors R14 and R15. The second terminal of the capacitor C11 and the first terminal of the capacitor C12 are electrically connected to each other and the resistor R5.

The AC-DC converter 942 includes the rectifying diode D3 electrically connected between a terminal of each of the resistor R5 and the smoothing capacitor C3.

The current sensing unit 930 includes the diodes D1 and D2 electrically connected in parallel between the secondary coil L12 of the transformer T1 and the secondary coil L22 of the transformer T2. As described above, the diodes D1 and D2 are arranged opposite each other with respect to the second terminals of each of the secondary coils L12 and L22, and the resistor R1 is connected to the diode D1 and the second terminal of the secondary coil L22 of the transformer T2, which is also electrically connected to ground. The current sensing signal Sc is outputted between the diode D1 and the resistor R1 and is applied to the inverter controller 923.

Operation of the lamp unit 910, the inverter 920*a*, the current sensing unit 930, and the arc sensing unit 940*a* will now be described.

As described above referring to FIG. 4, the switching unit 922 of the inverter 920*a* converts the DC voltage (not shown) from the external source into the AC voltage and applies the AC voltage to the primary coils L11 and L21 of the transformers T1 and T2.

The transformers T1 and T2 boost up the AC voltage from the switching unit 922 in response to a turns ratio of the primary coils L11 and L21 and the secondary coils L12 and L22, respectively, to output a high voltage to be applied to the lamp LP of the lamp unit 910, thereby turning the lamp LP of the lamp unit 910 on.

Voltages boosted by each transformer T1 and T2 have substantially a same magnitude, but have phases inverted with respect to each other. Thus, a magnitude of voltage applied to the lamp LP is double output voltage from each of the transformers T1 and T2.

The voltage applied to the lamp LP is applied to the first and second filtering subunits 943 and 944. The voltage dividers DV1 and DV2 of the first and second filtering subunits 943 and 944 divide the voltage. The capacitors C11 and C12 pass high frequency signals, i.e. high frequency components including the arc discharge. Output signals from the first and second filtering subunits 943 and 944 are summed and applied to the AC-DC converter 942. Signals not passed through the filtering unit 941*a* flow to ground via the resistor R5.

As described above referring to FIG. 4, the respective first and second filtering subunits 943 and 944 pass only signals having a frequency defined by a capacitance of the capacitors C11 and C12 and the resistance value of the resistor R5. Thus, by adjusting the capacitance of the capacitors C11 and C12 and the resistance value of the resistor R5, a frequency of signals passed by the first and second filtering subunits 943 and 944 is, for example, about 3 MHz or more corresponding to a frequency of the arc discharge.

The AC-DC converter 942 half-wave rectifies the filtered signals by using the rectifying diode D3, smoothes the half-wave rectified signals by the smoothing capacitor C3, and applies smoothed signals to the inverter controller 923.

As described above, the inverter controller 923 compares the arc sensing signal Sa to the reference voltage Vref, and turns off the lamp LP or maintains the lighting state of the lamp LP in response to a result of such comparison.

In response to the arc discharge being generated on at least one end of the lamp LP, the first and second filtering subunits 943 and 944 extract the high frequency component corresponding to the arc discharge and the inverter controller 923 turns off the lamp LP in response to the extracted high frequency component.

Meanwhile, as shown in FIG. 6, the current sensing unit 930 senses a sensed current flowing through the secondary coil L12 of the transformer T1, not a current flowing through the lamp LP, and applied a voltage proportional to the sensed current as the current sensing signal Sc to the inverter controller 923. However, the current flowing through the secondary coil L12 of the transforming unit 921*a* is proportional to the current flowing through the lamp LP. The inverter controller 923 varies a level of the DC control signal which changes the frequency and period etc. of the AC voltage applied to the transforming unit 921*a* from the switching unit 922, in response to the current sensing signal Sc.

Embodiments of the present invention described above are applicable to multiple lamps controlled in parallel by one transformer or a pair of transformers as well as to one lamp controlled by one transformer or a pair of transformers. In an exemplary embodiment, a number of filtering subunits is preferably equal to a number of transformers.

Next, referring to FIGS. 7 to 10, in response to arc discharge generation, the dimming control signal, lamp current flowing through the lamp LP and variation of a detected signal at a detection point will be described.

Figure 7:
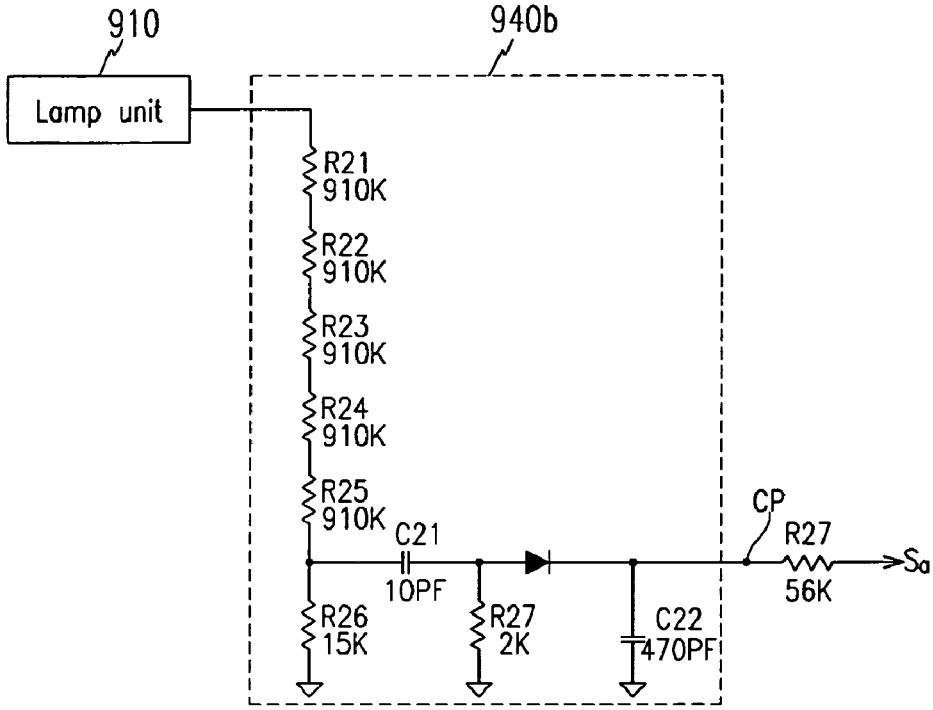
FIG. 7 is a circuit diagram of an arc sensing unit according to an exemplary embodiment of the present invention.
Figure 8:
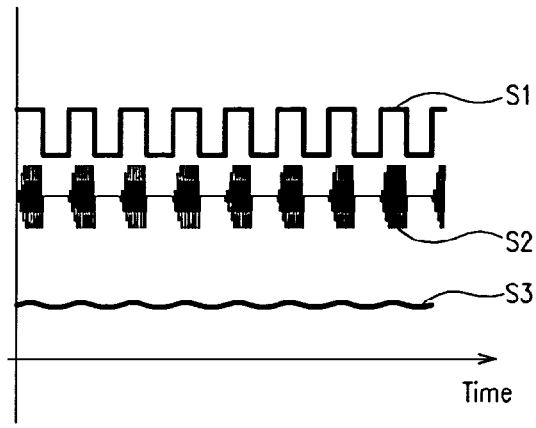
FIG. 8 illustrates a brightness control signal of 50% duty ratio applied to an inverter controller, a lamp current flowing through a lamp and a detected signal detected at a detection point of the circuit diagram shown in FIG. 7.
Figure 9:
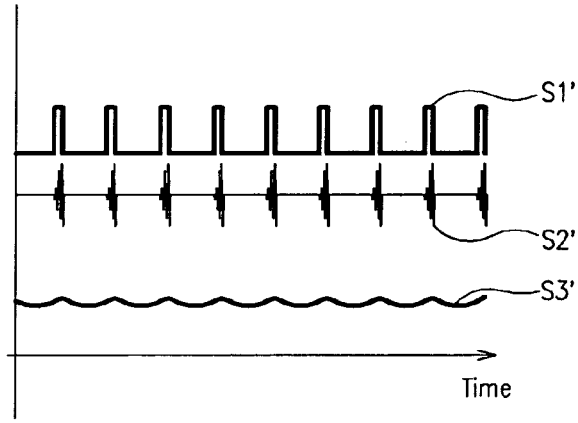
FIG. 9 illustrates the brightness control signal of 20% duty ratio applied to the inverter controller, the lamp current flowing through the lamp and the detected signal detected at the detection point of the circuit diagram shown in FIG. 7.
Figure 10:
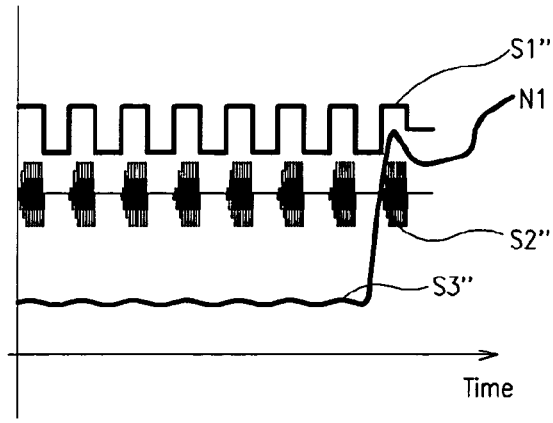
FIG. 10 illustrates the brightness control signal of 50% duty ratio applied to the inverter controller, the lamp current flowing through the lamp and the detected signal detected at the detection point in response to an arc being generated in the circuit diagram shown in FIG. 7.

FIG. 7 is a circuit diagram of an experimental arc sensing unit 940*b* manufactured based on an experiment according to the exemplary embodiments of the present invention. FIG. 8 illustrates a brightness control signal of 50% duty ratio applied to the inverter controller, the lamp current flowing through the lamp and a detected signal detected at a detection point in the circuit diagram shown in FIG. 7. FIG. 9 is illustrates the brightness control signal of 20% duty ratio applied to the inverter controller, the lamp current flowing through the lamp and the detected signal detected at the detection point in the circuit diagram shown in FIG. 7, and FIG. 10 is illustrates the brightness control signal of 50% duty ratio applied to the inverter controller, the lamp current flowing through the lamp and a detected signal detected at the detection point when the arc discharge is generated in the circuit diagram shown in FIG. 7.

As shown in FIG. 7, the experimental arc sensing unit 940*b* is substantially similar to the arc sensing unit 940 shown in FIG. 4. The experimental arc sensing unit 940*b* includes resistors R21-R26 forming a voltage divider of the experimental arc sensing unit 940*b*. Resistance values of the resistors R21-R25 electrically connected in series from the lamp unit 910 are each about 910 kΩ, and a resistance value of the resistor R26 connected to ground is about 15 kΩ. Additionally, capacitance of a high frequency filtering capacitor C21 is about 10 pF and capacitance of a smoothing capacitor C22 is about 470 pF, and a resistance value of a high frequency filtering resistor R27 is about 2 kΩ.

As shown in FIG. 8, when no arc was generated and duty ratio of the dimming control signal S1 was 50%, the lamp current measured by a separate measuring device was illustrated by waveform S2 and the detected signal detected at a detection point CP in FIG. 7 was illustrated by a waveform S3. As shown in FIG. 9, when no arc was generated and the duty ratio of the dimming control signal S1' was 20%, the lamp current was illustrated by waveform S2' and the detected signal at the detection point CP had a waveform S3'. During this time, the dimming control signal S1' was a pulse width modulation signal pulse width modulated for controlling brightness of the lamp LP.

As shown in FIGS. 8 and 9, a noise component of about 1 MHz or less included in a normal signal such as the dimming control signal S1 etc. caused a small ripple in the detected signals at the detection point CP shown by S3 and S3'. However, the experimental arc sensing unit 940*b* according to the experiment did not sense the noise component as the arc discharge. Thus the lamp LP remained turned on normally.

However, as shown in FIG. 10, in response to arc generation as shown by N1 and the duty ratio of the dimming control signal S1 being 50%, the detected signal at the detection point CP had a waveform S3" and the lamp current had a waveform S2." Thus, the experimental arc sensing unit 940*b* detected the arc as shown by waveform S3" and turned off the lamp LP.

When the voltage divider includes capacitors electrically connected in series with each other instead of the resistors R21-R25, an arc discharge of about 30 MHz or more was filtered.

Power consumption and heat loss of the arc sensing unit 940 will now be described.

When the lamp LP is in a lighting state, the voltage applied to the lamp LP is, for example, about 750V and, as described above, the resistance value of the five resistors R21-R25 are each about 910 kΩ. Accordingly, since consumption power P of the resistors R21-R25 is $P=V^2/(910\ k\Omega\times5)$, the consumption power P is about 0.12 KW. However, since the lamp LP consumes about 1000 W or more, the consumption power of about 0.12 KW may be ignored.

In addition, when a circumference temperature of any resistor in the inverter was about 35.1° C. to 35.8° C., temperature of the resistor itself was about 32.5° C. to 35.6° C. Since the temperatures are similar to each other, it is considered that the heat loss due to the resistors R21-R25 is minimal. Thus, the consumption power or heat loss due to the arc sensing unit 940 is minimal.

According to the present invention, when the arc discharge is generated, since the high frequency component of the arc discharge is sensed to detect arc generation for controlling the lamp, the lamp is protected from the arc discharge, thereby a lifetime of the lamp may be extended.

Moreover, since the lamp is controlled by detecting the arc discharge and differentiating the noise component, reliability is improved. Additionally, consumption power or heat loss due to the arc sensing unit is small and can be ignored.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. A driving device of a light source for a display device, the light source including a lamp having a first terminal and a second terminal, the driving device comprising:

an arc sensing unit connected to at least one of the first and second terminals and extracting a high frequency component from a voltage of the least one of the first and second terminals and generating an arc sensing signal in response to the high frequency component; and an inverter controlling the light source in response to the sensing signal.

2. The driving device of claim 1, wherein the light source is turned off in response to the high frequency component being larger than a predetermined value.

3. The driving device of claim 1, wherein the arc sensing unit includes a high pass filter extracting the high frequency component.

4. The driving device of claim 3, wherein the arc sensing unit further comprises a voltage divider dividing the voltage applied to the light source to supply to the high pass filter.

5. The driving device of claim 4, wherein the voltage divider comprises a plurality of resistors electrically connected in series.

6. The driving device of claim 3, wherein the arc sensing unit further comprises an alternating current to direct current (AC-DC) converter converting an AC signal from the high pass filter into a DC signal.

7. The driving device of claim 6, wherein a voltage of the first terminal of the lamp is larger than a voltage of the second terminal of the lamp.

8. The driving device of claim 7, further comprising: a current sensing unit sensing a current flowing through the light source and applying a current sensing signal in response to the current flowing through the light source to the inverter.

9. The driving device of claim 1, wherein the arc sensing unit comprises:

a first high pass filter extracting high frequency component from a voltage the first terminal of the light source; and a second high pass filter extracting high frequency component from a voltage of the second terminal of the light source, wherein the voltage the first terminal of the light source has an inverted phase with respect to the voltage of the second terminal of the light source.

10. The driving device of claim 9, wherein the arc sensing unit further comprises:

a first voltage divider dividing the voltage of the first terminal of the light source and applying a first divided voltage to the first high pass filter; and a second voltage divider electrically connected to the first voltage divider and dividing the voltage of the second terminal of the light source, and applying a second divided voltage to the second high pass filter.

11. The driving device of claim 10, wherein the first and second voltage dividers each comprise a plurality of resistors electrically connected in series with each other.

12. The driving device of claim 9, wherein the inverter comprises a first transformer and a second transformer electrically connected to the first and second terminals of the light source, respectively.

13. The driving device of claim 12, further comprising a current sensing unit electrically connected between the first transformer and the second transformer, and sensing a current flowing through the source light and applying a current sensing signal to the inverter.

14. The driving device of claim 1, further comprising a current sensing unit electrically connected to the light source and configured to produce a current sensing signal in response to a current flowing through the light source, wherein the inverter controls the light source in response the current sensing signal.

15. The driving device of claim 14, wherein the inverter comprises an inverter controller configured to control a frequency and period of the voltage applied to the light source in response to the current sensing signal.

16. A driving device of a light source for a display device, the light source including a lamp, the driving device comprising:

an inverter applying an AC voltage to the lamp and turning on and off the lamp;

a voltage divider electrically connected between the lamp and ground;

a high pass filter electrically connected to the voltage divider; and an AC-DC converter electrically connected to the high pass filter and the inverter.

wherein the AC-DC converter comprises a diode having an anode electrically connected to the high pass filter and a cathode electrically connected to a second capacitor electrically connected between the diode and ground.

17. The driving device of claim 16, wherein the voltage divider comprises a plurality of resistors electrically connected in series between the lamp and ground.

18. The driving device of claim 16, wherein the high pass filter comprises a first capacitor electrically connected to the voltage divider and a resistor electrically connected between the first capacitor and ground.

19. The driving device of claim 18, wherein the AC-DC converter comprises the diode having the anode electrically connected to the first capacitor and the resistor.

20. A driving device of a light source for a display device, the light source including a lamp having a first terminal and a second terminal, the driving device comprising:

an inverter applying an AC voltage to the lamp and turning on and off the lamp;

a first voltage divider electrically connected to the first terminal of the lamp;

a second voltage divider electrically connected to the first voltage divider and the second terminal of the lamp;

a first high pass filter electrically connected to the first voltage divider;

a second high pass filter electrically connected to the second voltage divider; and an AC-DC converter electrically connected to the first and second high pass filters and the inverter.

21. A display device comprising:

pixels arranged in a matrix;

a light source including a lamp having a first terminal and a second terminal and supplying light to the pixels;

a high frequency sensing unit to at least one of the first and second terminals and extracting a high frequency component from a voltage of the least one of the first and second terminals and generating a high frequency sensing signal in response to the high frequency component; and an inverter controlling the light source in response to the high frequency sensing signal.

22. The display device of claim 21, wherein the high frequency sensing unit comprises a high pass filter extracting the high frequency component.

23. The display device of claim 22, wherein the high frequency sensing unit further comprises a voltage divider dividing the voltage of the light source and applying a divided voltage to the high pass filter.

24. The display device of claim 23, wherein the voltage divider comprises a plurality of resistors electrically connected in series.

25. The display device of claim 22, wherein the high frequency sensing unit comprises an AC-DC converter converting an AC signal from the high pass filter to a DC signal.

* * * * *